US007811058B2

(12) United States Patent
Tibbott et al.

(10) Patent No.: US 7,811,058 B2
(45) Date of Patent: Oct. 12, 2010

(54) COOLING ARRANGEMENT

(75) Inventors: Ian Tibbott, Lichfield (GB); Edwin Dane, Nottingham (GB)

(73) Assignee: Rolls-Royce plc, London (GB)

( * ) Notice: Subject to any disclaimer, the term of this patent is extended or adjusted under 35 U.S.C. 154(b) by 987 days.

(21) Appl. No.: 11/589,233

(22) Filed: Oct. 30, 2006

(65) Prior Publication Data

US 2007/0110580 A1 May 17, 2007

(30) Foreign Application Priority Data

Nov. 12, 2005 (GB) ..... 0523106.3

(51) Int. Cl.
*F01D 5/08* (2006.01)
*F01D 5/22* (2006.01)

(52) U.S. Cl. ..... 416/97 R; 416/193 A; 416/500

(58) Field of Classification Search ..... 415/115, 415/119; 416/97 R, 193 A, 500
See application file for complete search history.

(56) References Cited

U.S. PATENT DOCUMENTS 2,772,854 A * 12/1956 Anxionnaz ..... 416/190
3,923,420 A * 12/1975 Chifos ..... 416/190
4,872,812 A 10/1989 Hendley
5,143,517 A * 9/1992 Vermont ..... 416/190
5,205,713 A * 4/1993 Szpunar et al. ..... 416/193 A
5,388,962 A * 2/1995 Wygle et al. ..... 416/95
5,415,526 A * 5/1995 Mercadante et al. ..... 416/190
5,478,207 A * 12/1995 Stec ..... 416/219 R
6,261,053 B1 * 7/2001 Anderson et al. ..... 415/115
6,457,935 B1 10/2002 Antunes
6,851,932 B2 * 2/2005 Lagrange et al. ..... 416/190
7,021,898 B2 4/2006 Elliott
7,648,333 B2 * 1/2010 Tibbott et al. ..... 415/115

FOREIGN PATENT DOCUMENTS

EP 0 702 131 A 3/1996
JP 64-63605 A 3/1983
JP 9-303107 A 11/1997

* cited by examiner

*Primary Examiner*—Edward Look
*Assistant Examiner*—Nathaniel Wiehe
(74) *Attorney, Agent, or Firm*—Jeffrey S. Melcher; Manelli Denison & Selter PLLC

(57) ABSTRACT

Cooling with regard to high-pressure turbine platforms is important in order to maintain gas turbine engine efficiency. Cottage Roof dampers located below junction gaps between adjacent platforms have been used but tend to present spent coolant flow at a high angle relative to hot gas flows about the aerofoil blades. The present arrangement has the junction gap angled such that the emergent coolant flow remains adjacent to the suction side to create a coolant film lingering above that suction side of the platform.

13 Claims, 3 Drawing Sheets

COOLING ARRANGEMENT

CROSS-REFERENCE TO RELATED APPLICATIONS

This application claims priority to GB 0523106.3, filed 12 Nov. 2005.

BACKGROUND OF THE INVENTION

The present invention relates to a cooling arrangement and, more particularly, to a cooling arrangement utilised in a gas turbine engine with regard to inter-blade platforms.

It will be understood that the efficiency and output of a gas turbine engine is related directly to turbine gas temperature. In such circumstances it is desirable to operate a gas turbine engine at the highest temperature possible. At such temperatures it is necessary to provide cooling of components within the gas turbine engine in order to remain within acceptable temperature ranges for the materials from which various components are formed.

One of the most difficult locations to cool in a gas turbine engine is the inter-blade platform structure of the high-pressure turbine stage. In the past, embedded convective holes have been used, along with various film cooling configurations. However, these cooling schemes have proved problematic from a stress concentration point of view. The platform gas washed surfaces are highly-stressed both mechanically, due to the centrifugal loading, and thermally, due to the temperature gradients present. Drilling cooling holes has been successful in reducing the metal temperature level associated thermal gradients but these holes have significantly increased the local three-dimensional stress levels in the component and so have been counter-productive in terms of a desire for improved extension of component life.

More recently, as described in U.K. Patent application number 0304329.6, a cooling arrangement has been proposed which utilises a damper below a junction between platforms in order to release coolant. It will be understood that cooling air taken from the compressor used to cool the hot turbines is not used to extract work from the turbine. Extracting coolant, therefore, has an adverse effect on engine operating efficiency and it is, therefore, necessary to utilise cooling air as effectively as possible in order to reduce the amount of cooling air extracted. The controlled leakage of coolant through a series of staggered slots machined or cast into contact surfaces of a "Cottage Roof" damper is used to provide cooling about the platform. The coolant air is used initially to cool the disc post or zone between two disc fir tree mounting root serrations and this is bled from the cavity beneath the blade platform surfaces through the slots in the damper surface in order to cool the surfaces of the damper and the platform edges and then the coolant emerges into the gap or junction between two neighbouring platforms. The spent coolant then impingement cools the adjacent platform edge before escaping radially into the gas path and becoming entrained with the strong hot gas flows about the platform.

Although the "Slotted Cottage Roof Damper" arrangement described in the UK Patent application 0304329.6 provides distinct improvements and advantages over the previous approach, it will be appreciated that improvements can still be made. A primary disadvantage relates to the angle and, to a lesser extent, the velocity of the spent coolant emerging from the junction gap between neighbouring platform edges. In short, the spent coolant rapidly mixes with the hot gas-flows and, therefore, does not provide any significant cooling effect.

SUMMARY OF THE INVENTION

In accordance with the present invention there is provided an annular array of aerofoils for a gas turbine engine, the array defining a cooling arrangement, the arrangement comprising a junction gap between two overlapping platforms of adjacent aerofoils and a damper radially inwardly of the junction gap, a damper surface and a platform surface arranged to have a coolant flow passing between them in use, the arrangement characterised in that the junction gap is at an angle relative to a radial line to angularly present a coolant flow in use adjacent to an exit of the junction gap.

Preferably, the junction gap is angled ø at 60 degrees, but may be angled between 30 and 75 degrees. The angle of the junction gap varies along the length of the platforms.

Preferably, the damper surface has a ridge with surfaces either side and the angle of the junction gap is substantially aligned with one of the surfaces.

Normally, the junction gap forms a slot which is continuous along the length of the platforms.

Normally, the ridge is directly radially inward the slot.

Preferably, the surfaces are arranged such that respective coolant flows over both surfaces merge at the ridge to form the coolant flow presented adjacent to the exit of the junction gap.

Normally, the slot has an exit configured to present the coolant flow adjacent to the junction gap.

Preferably, the exit is arranged to present the coolant flow at a substantially consistent angle to gas flows over the platforms in use.

Typically, the exit comprises edges of each platform and one edge is displaced relative to the other edge.

Typically, one edge is displaced above the other edge such that the coolant flow is presented adjacent to the junction gap downstream of the raised component edge.

Preferably, a gas turbine engine includes an annular array of aerofoils as described in the above paragraphs.

BRIEF DESCRIPTION OF THE DRAWINGS

An embodiment of the present invention will now be described by way of example only, with reference to the accompanying drawings, in which:—

DETAILED DESCRIPTION OF THE INVENTION

Figure 1:
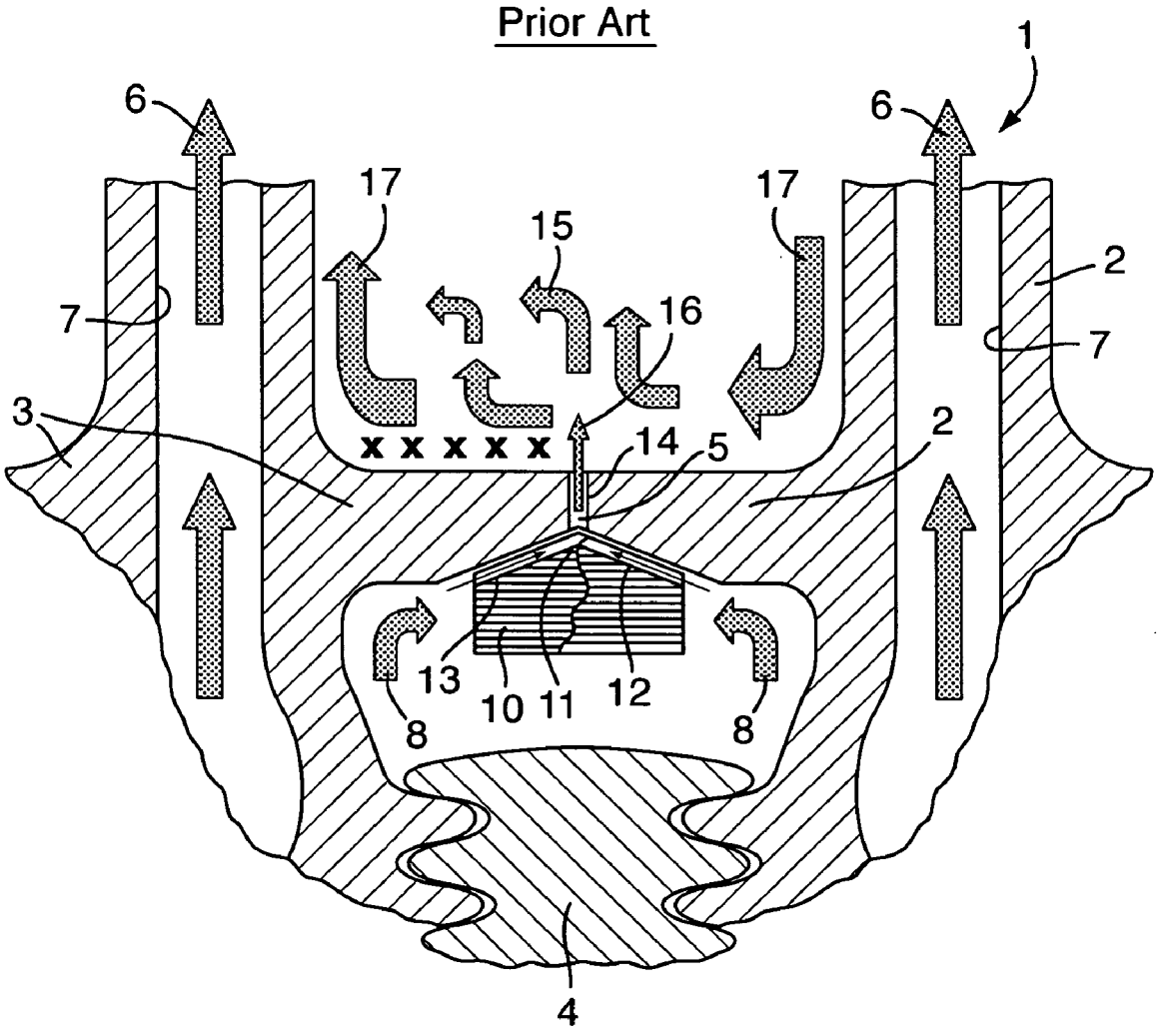
Fig.1. Prior Art
FIG. 1 is a schematic cross-section of a prior cooling arrangement.

As indicated above, a recent improved cooling arrangement for platform structures and particularly in an annular array of aerofoils in a gas turbine engine utilises a damper with a sloped ridge surface incorporating grooves through which coolant flows in order to cool the platform as well as the damper. This configuration is commonly referred to as a "Cottage Roof". FIG. 1 is a schematic cross-section of a prior cooling arrangement 1, generally described in U.K. Patent application number 0304329.6. Thus, the arrangement 1 has a first platform 2 and a second platform 3, secured upon the mounting 4, with a gap 5 between them. As indicated above, generally, in use these platforms and associated blades will be subject to high temperatures. Blade aerofoil coolant 6 will pass through conduits 7 in those aerofoils. The present cooling arrangement particularly relates to mounting disc and under-platform coolant flows 8.

As described previously, these coolant flows 8 are utilised to cool the platforms 2, 3. A damper 10 is presented and generally is in contact with opposed platform cavity surfaces 12, 13. It will be noted that the damper 10 has a roof-like cross-section with a ridge 11 and diverging slopes either side which engage the surfaces 12, 13. Grooves are provided between the damper 10 and the surfaces 12, 13 so that coolant flow can pass between these surfaces 12, 13 and the damper 10 to exit through a slot 14 into a space 15 above the platforms 2, 3. This ejected and spent coolant flow 16 mixes with hot gas flows 17 as a result of operation of the blade aerofoils. In such circumstances, the platform section 2 will generally be considered a pressure surface whilst the platform section 3 will generally be considered a suction surface. As the coolant flow 16 rapidly and turbulently mixes with the hot gas flow 17, it will be understood that some cooling effectiveness with regard to that flow 16 is lost, particularly with regard to potential in suction surface marked with XXXXX on the platform 3. Ideally, so-called film cooling where a coolant gas lingers about a surface could be utilised in order to protect the platform 3 from hot gas impingement.

Figure 2:
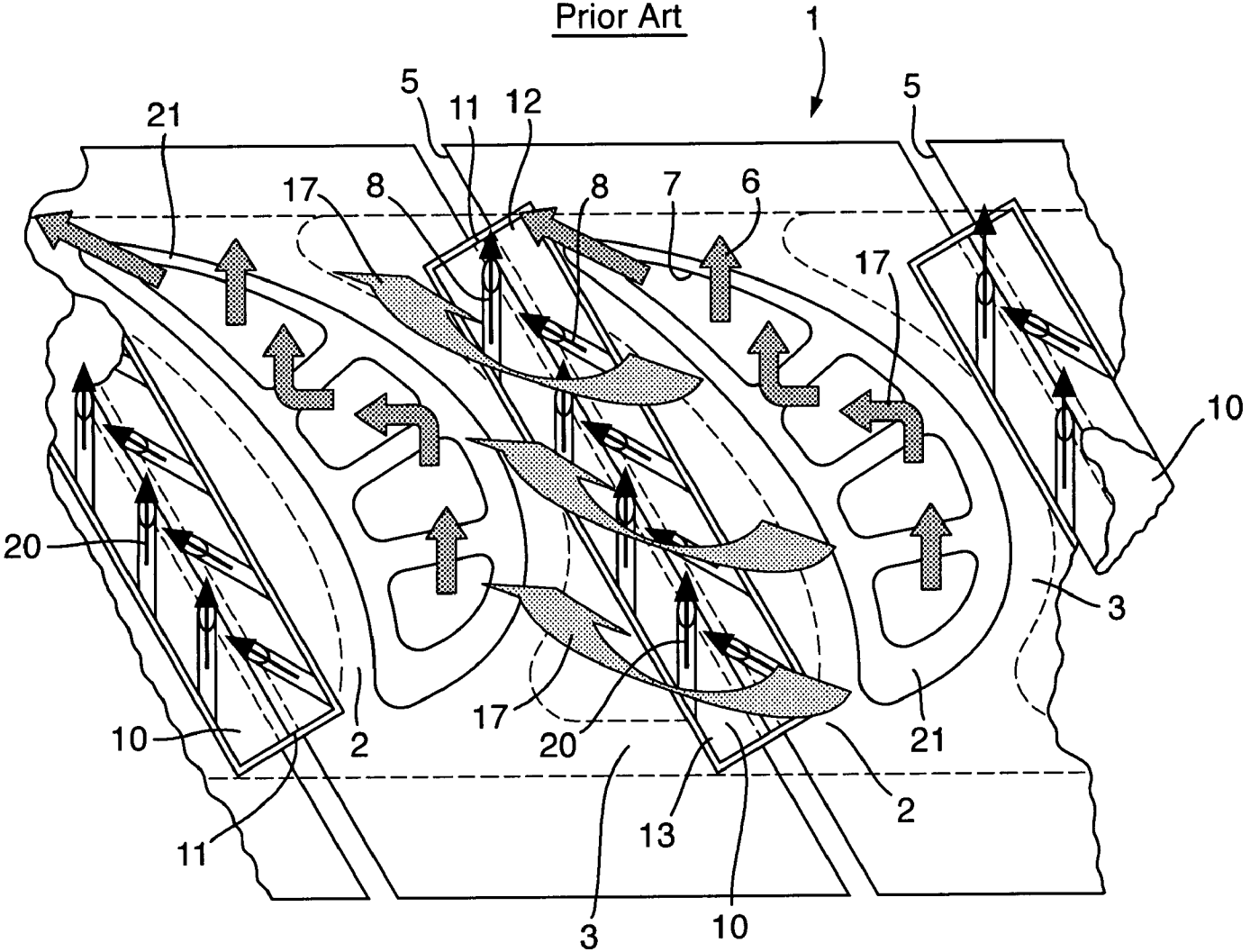
Fig.2. Prior Art
FIG. 2 is a schematic plan view of a cooling arrangement.

FIG. 2 provides a schematic plan view of the cooling arrangement depicted in FIG. 1. As can be seen, the damper 10 incorporates slots 20 in order to present coolant flow 16. This flow 16 as indicated mixes with hot gas flow 17 about aerofoils 21 and so normally provides little cooling effect.

It will be appreciated that the limitations with the prior cooling arrangement depicted in FIGS. 1 and 2 concerns the loss of coolant effect upon particularly the suction surface XXXXX of the platform 3. This is generally due to the angle and, to a lesser extent, the velocity of the spent coolant which emerges from the exit of the slot 14 in the junction gap between the juxtaposed platforms 2, 3. As a direct result of the fact that the coolant emerges across the gas path 17, that is to say perpendicular to the gas platform washed surfaces, there is no film cooling protection felt on the platform 3 suction surface XXXXX. It will be understood that this is due to the emerging stream of coolant from the slot being at a very different angle to the hot gas flow 17 direction and, consequently, the coolant 16 does not linger or "stick" by forced laminar flow to the platform 3 surface but rather becomes entrained and vigorously mixed with the hot gas flow 17, so destroying any potential film cooling effect. It will also be understood that the aerodynamic mixing losses associated with the emerging coolant are substantial and this may have a detrimental effect on turbine efficiency and so the specific fuel consumption of the gas turbine engine overall. Further problems with this prior arrangement relate to the possibility that there may be an unpredictable positive or negative step between juxtaposed platform edges as a result of component dimensional tolerance stack-up. Such steps between the edges of the opposed platforms may again prove detrimental to aerodynamic component and turbine efficiency.

Finally, with regard to the prior cooling arrangement depicted in FIGS. 1 and 2, it will be understood that the junction gap which creates the slot may change during engine cycling as a result of more expansion or less relative expansion between the components. Although there may not be an actual 'pinch point' where the platforms effectively engage and lock up with each other, there will be a point normally at the highest gas temperature condition experienced when the junction gap has a minimum dimension. During this period of minimum dimensions, the velocity of the emerging coolant 16 will reach a maximum so that if the cold or start-up gap has been set too narrowly then the coolant flow rate may be affected.

Figure 3:
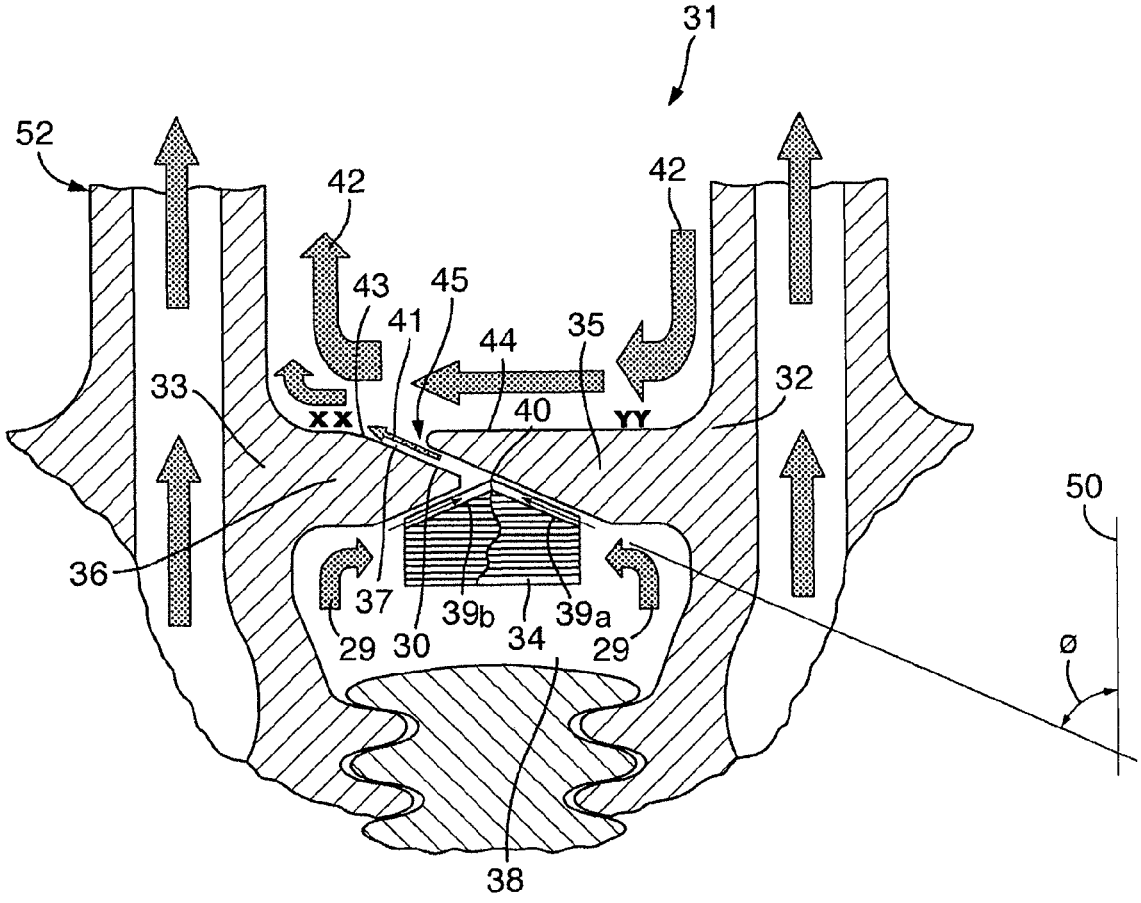
FIG. 3 is a schematic cross-section of a cooling arrangement in accordance with the present invention.

FIG. 3 provides a schematic cross-section of a cooling arrangement 31 for an annular array of aerofoils 52 in accordance with the present invention. Thus, two neighbouring blade platforms 32, 33 are damped and cooled using a "cottage roof" damper 34 as described previously with regard to FIG. 1. However, in the present cooling arrangement 31, pressure surface 35 of the platform 32 has been slightly extended circumferential and a corresponding platform suction surface 36 has been shortened to form a partially overlapping seal arrangement. Coolant 37 leaks from the under platform cavity 38 through the damper surfaces in grooves upon surface 39 on either side of the roof ridge 40 and convectively cools the damper 34 and platform 32, 33 edges. Coolant air 29 in the cavity 38 is taken from the usual compressor stages and coolant network. There is a junction gap 30 between platforms 32, 33. An emergent coolant flow 41 then cools by impingement the neighbouring platform edges 43, 44.

The coolant flow 29 meets in a continuous stream and flows between the juxtaposed neighbouring platform edges 32, 33 in a continuous slot formed between the adjacent platform edges as a junction gap to emerge as coolant flow 41. The coolant flow 41 emerges as a continuous film onto the platform suction surface XX before becoming entrained by hot gas secondary flows 42 that are a characteristic of a rotating aerofoil endwall geometry. The gentle mixing of the coolant 41 within the secondary flow hot gas 42 is achieved by consistently directing the film in substantially the same direction as the secondary flows 42. In addition, a platform pressure surface YY and the suction surface XX are designed with a negative step at an exit 45 with respect to the hot gas secondary flow 42 direction. This step is effectively filled in with the emergent spent cooled flow 41 through the junction gap between the adjacent platforms 32, 33. As a consequence, the arrangement 31 is less sensitive to gas path discontinuities due to dimensional geometries. In short, the arrangement 31 is made such that there will always be a negative step between surface YY and surface XX. Similarly, the circumferential gap between neighbouring blade platforms 32, 33 which effectively controls the exit Mach number of the flow 41 will be less important from an aerodynamic loss point of view as the coolant 41 is being directed in substantially the same direction as the hot mainstream secondary flow.

In view of the above it will be appreciated that the present cooling arrangement 31 utilises a "Cottage Roof" damper including slots for projection of coolant flow whereby there is a proportion of coolant passing over each sloped surface until combined to pass through the slot between the platforms. This slot, as indicated, is at the junction gap between the platforms and is at an angle ø relative to a radial line 50. Although any angling of the junction gap is beneficial, a preferred range of angles ø is between 30 and 75 degrees and as shown in FIG. 3 the angle is approximately 60 degrees. The angle is preferably aligned with one of the slopes of the damper. In such circumstances the coolant flow emerges from the slot for appropriate film retention against the suction surface XX of the platform 33 for cooling effect and less turbulent loss with the hot gas flow 42.

Furthermore, angling the junction gap may be more complex where either different flow pattern occurs within the space between aerofoils or where the platform edges are curved in the axial direction. In either of these circumstances, the angle of the junction gap may vary along the length or edge of the platforms.

In the above circumstances it will be appreciated that the damper 34 utilised in accordance with the present arrangement will be similar to that utilised with regard to FIGS. 1 and 2. However, in an area immediately above the ridge 40 of the damper 34, rather than as described previously with respect to FIG. 1, the coolant flow components 39 passing over the respective slopes of the damper 34 to merge and project vertically upwards, it will be understood that one flow component 39*a* will be generally aligned with the gap between the platform 32, 33 whilst the other flow component 39*b* will normally be presented across that flow component 39*a*. In such circumstance there may be some coolant flow turbulence created directly above the ridge 40. In such circumstances, generally, as illustrated in FIG. 3, a mixing zone may be created to utilise or diminish the effects of such turbulence upon cooling within the arrangement 31.

The junction gap 30 is a slot which is normally continuous along the length of the platforms 32, 33 between the blades. In such circumstances a uniform film will be created upon the suction surface XX of the platform 33 to achieve efficient coolant effects.

It will be noted that in the cooling arrangement 31 there is now a lack of symmetry between the respective coolant flow components on either sloped side of the roof ridge 40, namely flow components 39*a* or 39*b* of the damper 34. It will be noted that the coolant flow component 39*a* on the pressure side of the damper wets a greater surface than the coolant flow component 39*b* on the suction side XX. In order to address this disparity the grooves on one side of the damper 34 may be increased or decreased in relative cross-section and the number and angular presentation of the grooves may be altered to achieve best cooling performance.

We claim:

1. An annular array of aerofoils for a gas turbine engine, the array defining a cooling arrangement comprising:

a junction gap between overlapping pressure and suction platforms of adjacent aerofoils;

a damper being located radially inwardly of the junction gap;

a damper surface; and a platform suction surface arranged to have a coolant flow passing between said platform suction surface and said damper surface in use, and a hot gas secondary flow passing, in use, from said pressure platform to said suction platform, wherein said junction gap is at an angle relative to a radial line to angularly present a coolant flow in use adjacent to an exit of the junction gap and substantially in the same direction as said hot gas secondary flow to form a continuous film onto the platform suction surface in use.

2. An annular array of aerofoils as claimed in claim 1 wherein the junction gap is angled "ϕ" between 30 and 75 degrees.

3. An annular array of aerofoils as claimed in claim 1 wherein the junction gap is angled "ϕ" is approximately 60 degrees.

4. An annular array of aerofoils as claimed in claim 1 wherein the angle of the junction gap varies along the length of the platforms.

5. An annular array of aerofoils as claimed in claim 1 wherein the junction gap forms a slot which is continuous along the length of the platforms.

6. An annular array of aerofoils as claimed in claim 5 wherein the ridge is directly radially inward the slot.

7. An annular array of aerofoils as claimed in claim 5 wherein the slot has an exit configured to present the coolant flow adjacent to the junction gap.

8. An annular array of aerofoils as claimed in claim 7 wherein the exit is arranged to present the coolant flow at a substantially consistent angle to gas flows over the platforms in use.

9. An annular array of aerofoils as claimed in claim 7 wherein the exit comprises edges of each platform and one edge is displaced relative to the other edge.

10. An annular array of aerofoils as claimed in claim 9 wherein one edge is displaced above the other edge such that the coolant flow is present adjacent to the junction gap downstream of the raised component edge.

11. A gas turbine engine including an annular array of aerofoils as claimed in claim 1.

12. An annular array of aerofoils for a gas turbine engine, the array defining a cooling arrangement, the arrangement comprising:

a junction gap between two overlapping platforms of adjacent aerofoils;

a damper radially inwardly of the junction gap;

a damper surface; and a platform surface arranged to have a coolant flow passing between them in use; wherein the junction gap is at an angle relative to a radial line to angularly present a coolant flow in use adjacent to an exit of the junction gap, and wherein the damper surface has a ridge with surfaces either side and the angle of the junction gap is substantially aligned with one of the surfaces.

13. An annular array of aerofoils as claimed in claim 12 wherein the thereon wherein the surfaces are arranged such that respective coolant flows over both surfaces merge at the ridge to form the coolant flow presented adjacent to the exit of the junction gap.

* * * * *